United States Patent [19]

Uemura et al.

[11] Patent Number: 4,931,423

[45] Date of Patent: Jun. 5, 1990

[54] IMAGE RECEIVING MEDIUM FOR USE WITH SUBLIMATION-TYPE THERMAL IMAGE TRANSFER RECORDING MEDIUM

[75] Inventors: Hiroyuki Uemura, Numazu; Akira Suzuki, Mishima; Masaru Shimada, Shizuoka; Hidehiro Mochizuki, Numazu, all of Japan

[73] Assignee: Ricoh Company, Ltd., Tokyo, Japan

[21] Appl. No.: 386,255

[22] Filed: Jul. 28, 1989

[30] Foreign Application Priority Data

Jul. 29, 1988 [JP] Japan ..... 63-190051

[51] Int. Cl.[5] ..... B41M 5/035; B41M 5/26

[52] U.S. Cl. ..... 503/227; 8/471; 346/135.1; 428/195; 428/212; 428/913; 428/914

[58] Field of Search ..... 8/471; 346/135.1; 428/195, 913, 914, 212; 503/227

[56] References Cited

U.S. PATENT DOCUMENTS 4,720,480 1/1988 Ito et al. ..... 503/227

*Primary Examiner*—Bruce H. Hess

*Attorney, Agent, or Firm*—Oblon, Spivak, McClelland, Maier & Neustadt

[57] ABSTRACT

An image receiving medium for use with a sublimation-type thermal image transfer recording medium is disclosed, which comprises a substrate; an a dye receiving layer formed thereon comprising (1) a resin, as the main component, which can be dyed with a sublimation-type dye, and (2) a silicone oil contained therein in such a fashion that the concentration of the silicone oil increases in the direction of the depth of the dye receiving layer from the bottom thereof adjacent to the substrate toward the upper free surface thereof.

9 Claims, 2 Drawing Sheets

IMAGE RECEIVING MEDIUM FOR USE WITH SUBLIMATION-TYPE THERMAL IMAGE TRANSFER RECORDING MEDIUM

BACKGROUND OF THE INVENTION

1. Field of the Invention

This invention relates to an image receiving medium for use with a sublimation-type thermal image transfer recording medium which comprises an image transfer layer containing a thermally sublimable dye.

2. Discussion of Background

The sublimation-type thermal image transfer recording method, which successfully achieves half-tone printing and full color hard copying, is growing in popularity these days. In this method, a thermal image transfer recording medium which comprises an image transfer layer containing a thermally sublimable dye is used in combination with an image receiving medium which receives the dye sublimed by heat applied from the back side of the recording medium.

In a dye receiving layer of the image receiving medium for use in the above recording method, thermoplastic resins which are highly receptive to the thermally sublimable dye, such as polyester resin, are employed. These resins, however, have low heat resistance, so that the dye receiving layer containing these resins tends to fuse and stick to an image transfer recording medium (a color sheet) when images are thermally recorded. In addition, the dye receiving layer once sticked to the color sheet cannot be smoothly separated from the color sheet when the recording is completed.

In order to overcome the above shortcoming, a releasing material such as silicone oil is generally incorporated into the dye receiving layer.

In the case where silicone oil is incorporated into the dye receiving layer, the releasing ability between the image transfer recording medium and the image receiving medium becomes high as the incorporation amount of the silicone oil is increased. When the silicone oil is employed in such an amount that the image receiving layer can easily peel off the image transfer recording medium, the adhesion between the dye receiving layer and a substrate, on which the dye receiving layer is formed, becomes weak. As a result, the dye receiving layer does not peel off the image transfer recording medium, but undesirably peel off the substrate when the thermal recording is completed.

SUMMARY OF THE INVENTION

Accordingly, an object of the present invention is to provide an image receiving medium for use with a sublimation-type thermal image transfer recording medium, which has high adhesion between a substrate and a dye receiving layer and can well peel off an image transfer recording medium when thermal recording is completed.

The above object of the present invention can be attained by an image receiving medium comprising a substrate, and a dye receiving layer formed thereon comprising (1) a resin, as the main component, which can be dyed with a thermal-sublimation type dye, and (2) a silicone oil contained therein in such a fashion that the concentration of the silicone oil increases in the direction of the depth of the dye receiving layer from the bottom thereof adjacent to the substrate toward the upper free surface thereof.

BRIEF DESCRIPTION OF THE DRAWINGS

A more complete appreciation of the invention and many of the attendant advantages thereof will be readily obtained as the same becomes better understood by reference to the following detailed description when considered in connection with the accompanying drawings, wherein.

DETAILED DESCRIPTION OF THE PREFERRED EMBODIMENTS

By referring now to the accompanying drawings, the present invention will be described in detail.

Figure 1:
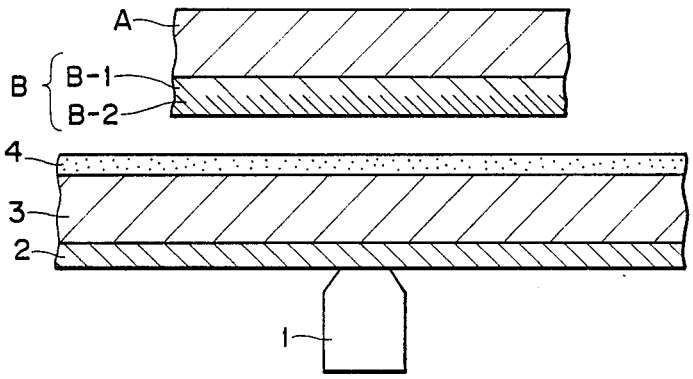
FIG. 1 is a schematic cross-sectional view showing the mechanism of the sublimation-type thermal image transfer recording.

An image receiving medium according to the present invention is composed of a substrate and a dye receiving layer as indicated by symbols A and B in FIG. 1. The dye receiving layer B, formed on the substrate A, comprises (1) a resin, as the main component, which can be dyed with a thermal-sublimation type dye, and (2) a silicone oil. The concentration of the silicone oil in the free surface, indicated by symbol B-2, is higher than that in the portion, indicated by symbol B-1, adjacent to the substrate A. A sublimation-type image transfer recording medium is composed of a heat resistant layer 2, a substrate 3 and a dye transfer layer 4. Reference numeral 1 denotes a thermal head.

The thermally sublimable dye contained in the dye transfer layer 4 of the sublimation-type image transfer recording medium is sublimed when heat is applied thereto by the thermal head 1. The sublimed dye diffuses and transfers to the dye receiving layer B of the image receiving medium. The dye thus transferred to the dye receiving layer B spreads therein, and dyes the dye-receptive resin contained therein as the main component.

Figure 2:
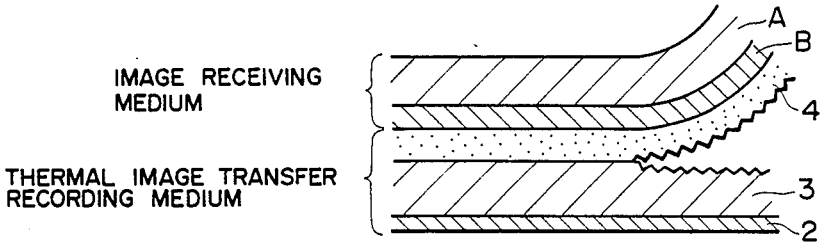
FIG. 2 is a cross-sectional view showing undesirable peeling between an image transfer recording medium and the conventional image receiving medium containing only a small amount of a releasing material in its image receiving layer.
Figure 3:
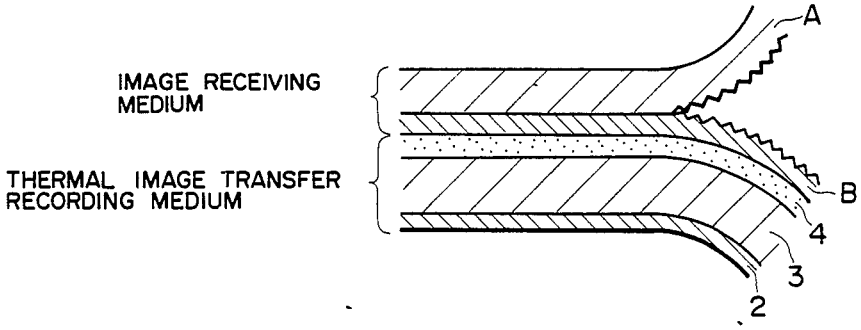
FIG. 3 is a cross-sectional view showing undesirable peeling between an image transfer recording medium and the conventional image receiving medium containing an excess amount of a releasing material in its image receiving layer.
Figure 1:
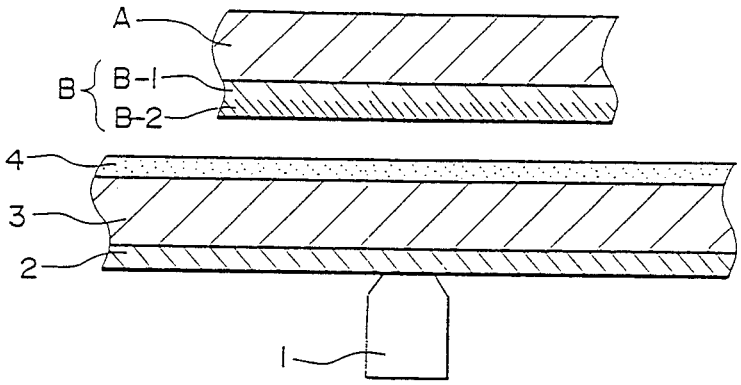
Figure 2:
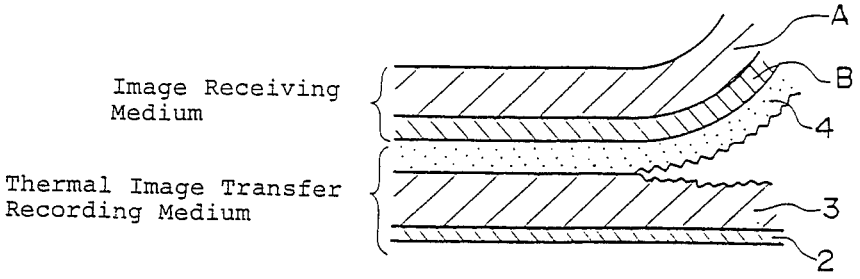
Figure 3:
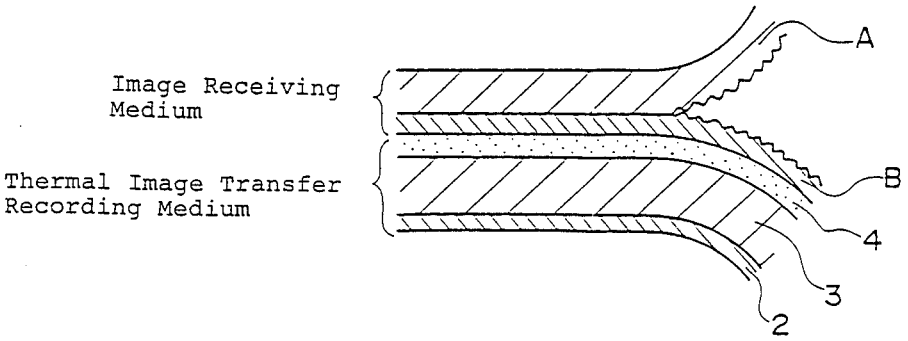

In general, a releasing material such as silicone oil is incorporated into the dye receiving layer B in order to prevent the image receiving medium from fusing and sticking to the image transer recording medium while recording, and to enhance the releasing ability therebetween after recording. When only a small amount of the releasing material is incorporated into the dye receiving layer, the satisfactory releasing effect cannot be obtained. In this case, the dye transfer layer 4 is torn from the substrate 3 and transfers to the dye receiving layer B, as shown in FIG. 2, when recording is completed. On the contrary, when an excess amount of the releasing material is incorporated, the adhesion between the substrate A and the dye receiving layer B becomes weak. For this reason, the dye receiving layer B is torn from the substrate A and transfers to the dye transfer layer 4 as shown in FIG. 3.

The silicone oil incorporated into the dye receiving layer B of the image receiving medium according to the present invention has the concentration-gradient. Namely, the free surface B-2 of the dye receiving layer B contains a large amount of the silicone oil in comparison with the portion B-1 adjacent to the substrate A. Therefore, the releasing ability between the dye receiving layer B and the dye transfer layer 4 is satisfactorily high, and at the same time, the adhesion between the substrate A and the dye receiving layer B is kept high. Thus, the dye receiving layer B is prevented from peeling off the substrate A.

Specific examples of the silicone oil incorporated into the dye receiving layer B in the present invention include "KF96", "KF99", "KF410", "KS707", "KM780", "KF393" and "KF857" (Trademarks), all available from Shin-Etsu Chemical Co., Ltd.; and "SF8417", "SF8411", "SH490", "SH28PA", "SF8427" and "SR2101" (Trademarks), all available from Toray Silicone Co., Ltd.

A preferred amount of the silicone oil incorporated into the portion B-1 of the dye receiving layer B is 0 to 2 parts by weight to 100 parts by weight of the resin contained in the portion B-1, and that of the silicone oil incorporated into the free surface B-2 is 1 to 20 parts by weight to 100 parts by weight of the resin contained in the free surface B-2. Both linear and stepwise gradients of the concentration of the silicone oil are acceptable in the present invention.

Examples of the resin employed as the main component of the dye receiving layer, which can be dyed with a thermal-sublimation type dye, include polyester, polycarbonate, polysulfone, polystyrene, polyvinyl alcohol, polyvinyl chloride, polyvinyl acetate, a copolymer of vinyl chloride and vinyl acetate, polyamide, polyurethane, and a copolymer of styrene and acrylic acid. Of these resins, a copolymer resin of vinyl chloride and vinyl acetate and a polyester resin are preferable.

Specific examples of the copolymer resin of vinyl chloride and vinyl acetate are "VYHH", "VYNS", "VYHD", "VYLF", "VMCH", "VMCC", "VAGH" and "VROH" (Trademarks), all available from Union Carbide Japan K.K., "Denka Vinyl #1000A", "Denka Vinyl #1000MT", "Denka Vinyl #1000D", "Denka Vinyl #1000L", "Denka Vinyl #1000CK2" and "Denka Vinyl #1000GKT" (Trademarks), all available from Denki Kagaku Kogyo K.K.

It is preferable that the above copolymer resin contain 80 wt. % or more of the vinyl chloride component, and 20 wt. % or less of the vinyl acetate component.

Specific Examples of the polyester resin include "Vylon 550", "Vylon 300", "Vylon 103", "Vylon 600", "Vylon 200", "Vylon 220", "Vylon 280" and "Vylon 290" (Trademarks), all available from Toyobo Co., Ltd., and "Eliter 3200", "Eliter 3201", "Eliter 3203", "Eliter 3210", "Eliter 3220", "Eliter 3230", "Eliter 3300", "Eliter 3400", "Eliter 3500" and "Eliter 3600" (Trademarks), all available from Unitika Ltd.

A filler may be incorporated into the dye receiving layer B of the present invention. Examples of the filler include white pigments such as silica, titanium oxide and calcium carbonate. A preferred amount of the filler is 5 to 60 parts by weihgt of 100 parts by weight of the resin.

In addition, auxiliary components such as surface active agents, ultraviolet-ray absorbing agents and antioxidants may be incorporated into the dye receiving layer B, if necessary.

As the substrate A of the image receiving medium according to the present invention, a synthetic paper, a coated paper, a high quality paper, a gravure coated paper, a cellulose fiber paper and a plastic paper are employable either singly or in combination.

A preferred amount of the dye receiving layer formed on the substrate is 0.1 to 20 g/m$^2$ (based on the solid components).

The image receiving medium for use with the sublimation-type thermal image transfer recording medium according to the present invention comprises a substrate and a dye receiving layer comprising as the main component a resin which can be dyed with a thermal-sublimation type dye, and a silicone oil. The silicone oil is incorporated into the dye receiving layer in such a fashion that the amount of the silicone oil incorporated into the free surface of the dye receiving layer is larger than that of the silicone oil incorporated into the portion adjacent to the substrate. Thus, there exists a gradient with respect to the concentration of the silicone oil contained in the dye receiving layer. Therefore, the image receiving medium of the present invention can overcome the previously mentioned shortcomings in the conventional image receiving medium.

Other features of this invention will become apparent in the course of the following description of exemplary embodiments, which are given for illustration of this invention and are not intended to be limiting thereof.

EXAMPLE 1

[Preparation of Liquid A-1]

The following components were well dispersed, thereby obtaining Liquid A-1 for the formation of a dye receiving layer.

| | parts by weight |
|---|---|
| Polyester resin (Trademark "Vylon 200" made by Toyobo Co., Ltd.) | 10 |
| Silicone oil (Trademark "SF8417" made by Toray Silicone Co., Ltd.) | 0.1 |
| Toluene | 40 |
| Methyl ethyl ketone | 40 |

[Preparation of Liquid A-2]

The following components were well dispersed, thereby obtaining Liquid A-2 for the formation of a dye receiving layer.

| | parts by weight |
|---|---|
| Polyester resin (Trademark "Vylon 200" made by Toyobo Co., Ltd.) | 10 |
| Silicone oil (Trademark "SF8417" made by Toray Silicone Co., Ltd.) | 1 |
| Toluene | 40 |
| Methyl ethyl ketone | 40 |

[Preparation of Image Receiving Medium]

Liquid A-1 was coated, using a wire bar, onto a synthetic paper (Trademark "Yupo FPG-150", made by Oji-Yuka Synthetic Paper Co., Ltd.) having a thickness of approximately 150 μm, and then dried at 75° C. for one minute. Liquid A-2 was then coated onto the above-formed layer using a wire bar, and dried at 75° C. for one minute. Thus, an image receiving medium No. 1 according to the present invention was prepared, which consists of two layers each containing different amount of the silicone oil.

[Preparation of Image Transfer Recording Medium]

On the other hand, a sublimation-type image transfer recording medium was prepared in the following manner. Liquid B having the following formulation was coated onto a substrate to form an ink layer having a thickness of approximately 2 μm. The substrate was a PET film having a thickness of 6 μm which had been provided with a backing layer approximately 1 μm thick, made of a silicone hardened resin. Thus, an image transfer recording medium was prepared.

| [Formulation of Liquid B] | parts by weight |
|---|---|
| Polyvinyl butyral resin (Trademark "BX-1" made by Sekisui Chemical Co., Ltd.) | 10 |
| Sublimable dye for cyan compound (Trademark "Kayaset 714" made by Nippon Kayaku Co., Ltd.) | 6 |
| Methyl ethyl ketone | 45 |
| Toluene | 45 |

[Recording Test]

The above-prepared image transfer recording medium was superposed on the image receiving medium so that the ink layer of the image transfer recording medium can face the dye receiving layer of the image receiving medium each other. Thermal energy was applied to the back side of the image transfer recording medium by a thermal head. Thus, an image recording test was carried out by changing the thermal energy. The recording density of the thermal head was 6 dot/mm, and the recording power was 0.42 W/dot.

EXAMPLE 2

Example 1 was repeated except that Liquids A-1 and A-2 prepared in Example 1 were replaced with Liquids C-1, C-2 and C-3 each having the following formulations, whereby an image receiving medium No. 2 according to the present invention was prepared. In the above, Liquids C-1, C-2 and C-3 were coated in this order to form a dye receiving layer.

| | parts by weight |
|---|---|
| [Formulation of Liquid C-1] | |
| Copolymer resin of vinyl chloride and vinyl acetate (Trademark "VYHH" made by Union Carbide Japan K.K.) | 10 |
| Toluene | 40 |
| Methyl ethyl ketone | 40 |
| [Formulation of Liquid C-2] | |
| Copolymer resin of vinyl chloride and vinyl acetate (Trademark "VYHH" made by Union Carbide Japan K.K.) | 10 |
| Silicone oil (Trademark "KF393" made by Shin-Etsu Chemical Co., Ltd.) | 0.5 |
| Toluene | 40 |
| Methyl ethyl ketone | 40 |
| [Formulation of Liquid C-3] | |
| Copolymer resin of vinyl chloride and vinyl acetate (Trademark "VYHH" made by Union Carbide Japan K.K.) | 10 |
| Silicone oil (Trademark "KF393" made by Shin-Etsu Chemical Co., Ltd.) | 1 |
| Toluene | 40 |
| Methyl ethyl ketone | 40 |

By using the above-prepared image receiving medium and the image transfer recording medium prepared in Example 1, an image recording test was carried out as in Example 1.

COMPARATIVE EXAMPLE 1

Example 1 was repeated except that Liquids A-1 and A-2 were replaced with Liquid D having the following formulation, whereby a comparative image receiving medium No. 1 was prepared. In the above, Liquid D was coated twice onto the synthetic paper serving as a substrate.

| [Formulation of Liquid D] | parts by weight |
|---|---|
| Polyester resin (Trademark "Vylon 290" made by Toyobo Co., Ltd.) | 10 |
| Silicone oil (Trademark "SF8417" made by Toray Silicone Co., Ltd.) | 0.5 |
| Toluene | 40 |
| Methyl ethyl ketone | 40 |

By using the above-prepared image receiving medium and the image transfer recording medium prepared in Example 1, an image recording test was carried out as in Example 1.

COMPARATIVE EXAMPLE 2

Example 2 was repeated except that Liquid C-3 prepared in Example 2 was coated twice onto the synthetic paper instead of coating Liquids C-1, C-2 and C-3 in this order, whereby a comparative image receiving medium No. 2 was prepared.

By using the above-prepared image receiving medium and the image transfer recording medium prepared in Example 1, image recording test was carried out in the same manner as in Example 1.

After the image recording test, the surfaces of the image transfer recording media and the image receiving media were each visually observed. The results are shown in Table 1.

TABLE 1

| | |
|---|---|
| Example 1 | No problems were found on the surfaces of two media |
| Example 2 | No problems were found on the surfaces of two media |
| Comparative Example 1 | Transfer of the dye transfer layer to the image receiving medium was found |
| Comparative Example 2 | Transfer of the dye receiving layer to the image transfer recording layer was found |

The above results of the image recording test demonstrate that the image receiving media according to the present invention can smoothly peel off the image transfer recording medium, without causing any problems, after the recording is completed.

WHAT IS CLAIMED IS:

1. An image receiving medium for use with a sublimation-type thermal image transfer recording medium comprising:

a substrate; and a dye receiving layer formed thereon comprising (1) a resin, as the main component, which can be dyed with a sublimation-type dye, and (2) a silicone oil contained therein in such a fashion that the concentration of said silicone oil increases in the direction of the depth of said dye receiving layer from the bottom thereof adjacent to said substrate toward the upper free surface thereof.

2. The image receiving medium as claimed in claim 1, wherein the concentration of said silicone oil near said substrate is in such a range that the ratio by weight of said silicone oil to said sublimation-type dye is (0 to 2):100, and the concentration of said silicone oil near said upper free surface of said dye receiving layer is in such a range that the ratio by weight of said silicone oil to said sublimation-type dye is (1 to 20):100.

3. The image receiving medium as claimed in claim 1, wherein the concentration of said silicone oil increases linearly toward said upper free surface of said dye receiving layer.

4. The image receiving medium as claimed in claim 1, wherein the concentration of said silicone oil increases stepwise toward said upper free surface of said dye receiving layer.

5. The image receiving medium as claimed in claim 1, wherein said resin is selected from the group consisting of polyester, polycarbonate, polysulfone, polystyrene, polyvinyl alcohol, polyvinyl chloride, polyvinyl acetate, vinyl chloride/vinyl acetate copolymer, polyamide, polyurethane, styrene/acrylate copolymer.

6. The image receiving medium as claimed in claim 5, wherein said resin is vinyl chloride/vinyl acetate copolymer.

7. The image receiving medium as claimed in claim 5, wherein said resin is polyester resin.

8. The image receiving medium as claimed in claim 1, wherein said dye receiving layer further comprises a filler.

9. The image receiving medium as claimed in claim 8, wherein said filler is a white pigment selected from the group consisting of silica, titanium oxide and calcium carbonate, in an amount of 5 to 60 parts by weight to 100 parts by weight of said resin.

* * * * *

UNITED STATES PATENT AND TRADEMARK OFFICE

CERTIFICATE OF CORRECTION

PATENT NO. : 4,931,423

DATED : June 5, 1990

INVENTOR(S) : UEMURA ET AL.

It is certified that error appears in the above-identified patent and that said Letters Patent is hereby corrected as shown below:

In the Abstract, line 3:

"substrate; an a dye" should read:

--substrate; and a dye--

At column 3, line 63:

"by weihgt" should read:

--by weight--

Signed and Sealed this

Twelfth Day of May, 1992

*Attest:*

DOUGLAS B. COMER

*Attesting Officer*

*Acting Commissioner of Patents and Trademarks*